US005694995A

United States Patent [19]

Brand

[11] Patent Number: 5,694,995

[45] Date of Patent: Dec. 9, 1997

[54] METHOD AND APPARATUS FOR PREPARING A FLITCH FOR CUTTING

[75] Inventor: Robert D. Brand, Lawrence, Ind.

[73] Assignee: Capital Machine Company, Inc., Indianapolis, Ind.

[21] Appl. No.: 454,960

[22] Filed: May 31, 1995

[51] Int. Cl.[6] ..... B27C 1/00; B27M 1/08; B27L 5/06

[52] U.S. Cl. ..... 144/365; 144/3.1; 144/35.1; 144/93.1; 144/367; 144/356; 408/53; 408/62

[58] Field of Search ..... 144/3.1, 4.4, 35.1, 144/93.1, 108, 109, 162 R, 209.1, 214, 356, 365, 367, 368, 211, 212, 213; 408/62, 53

[56] References Cited

U.S. PATENT DOCUMENTS

| | | | |
|---|---|---|---|
| 793,306 | 6/1905 | Koss . | |
| 2,576,520 | 11/1951 | Koss | 144/178 |
| 2,676,627 | 4/1954 | McFall | 144/178 |
| 2,880,629 | 4/1959 | Pope et al. | 408/62 |
| 3,441,069 | 4/1969 | Koss | 144/309 |
| 3,491,812 | 1/1970 | Butler | 408/53 |
| 3,654,973 | 4/1972 | Koss | 144/178 |
| 3,680,612 | 8/1972 | Hale | 144/178 |
| 3,808,925 | 5/1974 | Hards | 83/346 |
| 3,905,408 | 9/1975 | Hale | 144/178 |
| 4,068,693 | 1/1978 | Cremona | 144/178 |
| 4,069,850 | 1/1978 | Cremona | 144/178 |
| 4,071,060 | 1/1978 | Busch | 144/365 |
| 4,392,519 | 7/1983 | Calvert | 144/212 |
| 4,503,896 | 3/1985 | Brand | 144/369 |
| 4,587,616 | 5/1986 | Weil | 364/475 |
| 4,601,317 | 7/1986 | Brand | 144/178 |
| 4,683,926 | 8/1987 | Weil | 144/178 |
| 5,101,874 | 4/1992 | Weil | 144/209 |
| 5,143,129 | 9/1992 | Toivio | 144/211 |
| 5,150,746 | 9/1992 | Weil | 144/209 |
| 5,333,658 | 8/1994 | Albion et al. | 144/213 |
| 5,385,184 | 1/1995 | Mellor | 144/178 |

FOREIGN PATENT DOCUMENTS

0627285 A2 7/1994 European Pat. Off. .

OTHER PUBLICATIONS

*Double Dogging Flitch System*, Sales Brochure of Capital Machine Co., Inc., Indianapolis, Indiana.

*Primary Examiner*—W. Donald Bray
*Attorney, Agent, or Firm*—Brinks Hofer Gilson & Lione

[57] ABSTRACT

The present invention includes an apparatus for preparing a flitch for slicing where the flitch includes a veneer-producing zone and a staylog-engaging zone. The apparatus comprises a drill mechanism for drilling a plurality of holes in the flitch and a mechanism for holding a flitch in a predetermined orientation relative to the drill mechanism. The holes are arranged in a predetermined pattern and extend from a flitch mounting surface to the veneer-producing zone so as to define a boundary between the veneer-producing zone and the staylog-engaging zone. A method for preparing a flitch for slicing comprises the steps of positioning the flitch in a preparing position and forming a plurality of dog-receiving holes in the flitch in a predetermined pattern so that each hole extends through the staylog-engaging zone to the veneer-producing zone. The flitch is mounted on the staylog by aligning the plurality of dog-receiving holes with a plurality of dogs coupled to the staylog and inserting the dogs into the dog-receiving holes and moving the flitch into engagement with the dogs.

34 Claims, 7 Drawing Sheets

METHOD AND APPARATUS FOR PREPARING A FLITCH FOR CUTTING

FIELD OF THE INVENTION

The present invention relates to an apparatus for preparing a flitch to be mounted on a staylog for cutting on a veneer slicer, and particularly to preparing a flitch for mounting so as to minimize the amount of waste veneer taken from the outside of a log. More particularly, the invention relates to preparing a flitch by forming a plurality of holes in the flitch for receiving dogs.

BACKGROUND OF THE INVENTION

Staylogs for use with veneer slicers are known. Such staylogs hold a flitch and move relative to a slicing knife. As the flitch passes the knife, the knife slices a sheet of veneer from the flitch.

Veneer slicers typically use a plurality of dogs to hold the flitch in position against a mounting surface on the staylog. The dogs are clamping members that extend from the mounting surface of the staylog and are positioned on either side of the flitch along the length of the staylog. Typically, the dogs include a sharp-edged portion oriented parallel to the mounting surface of the staylog to cut into the flitch and hold it in place against the staylog. The dogs are moved toward each other to pinch the flitch therebetween.

An alternative dogging arrangement is disclosed in U.S. Pat. No. 5,150,746 to Weil. Weil discloses a plurality of oval-shaped rotating dogs that include a sharp-edged portion at the ends of the major axis of the oval. The dogs are arranged in parallel rows along the mounting surface of the staylog. A plurality of axially extending grooves are cut into the mounting surface of the flitch. The grooves are cut to align with the rows of dogs and are sized to allow the dogs to fit up into the grooves when the major axis of the oval is aligned with the groove. When the flitch is mounted on the staylog, the oval-shaped dogs extend upwardly into the grooves and are rotated to engage the sharp-edged portion of the dogs with the flitch.

Regardless of whether clamping dogs or rotating dogs are used, conventional flitch mounting techniques require that the flitch mounting surface be positioned adjacent the staylog mounting surface. Unfortunately, the conventional mounting techniques cause some of the best veneer on a log to be wasted.

A flitch is formed by cutting a log down the middle along its longitudinal axis so that the plane formed by the cut defines a flitch mounting surface and the periphery of the log defines a veneer-producing surface. Conventionally, the mounting surface of the flitch is positioned adjacent the mounting surface of the staylog and the veneer-producing outer portion of the log is positioned to be sliced into sheets of veneer by the knife. However, because the tree trunk is naturally tapered, one end of the flitch is thicker than the other end, and consequently extends a greater distance from the mounting surface of the staylog. As a result, the veneer-producing zone of the flitch is frusto-conical, when viewed from the side of the flitch or from the knife.

As the staylog and the flitch are rotated, the knife first encounters the thickest portion of the flitch. With each rotation, the knife slices a longer veneer sheet until the entire length of the flitch is exposed to the knife. Once the entire length of the flitch is being sliced, subsequent sheets are of substantially uniform length. However, the initial sheets, which are cut from the best part of the log, are too short to be useful, and are thrown away as wasted product. In addition, with the prior art methods of retention, the long slots formed along the length of the flitch removed sufficient material from the flitch that the flitch lost its rigidity and would flex in response to the pressure of the slicing knife resulting in, at best, nonuniform and unacceptable slices of veneer. Consequently, some of the best veneer on a flitch is thrown away as waste.

Waste taken from the veneer-producing zone can be reduced by forming a generally semi-cylindrical veneer-producing zone and positioning the flitch on the staylog to retain the veneer-producing zone so that the axis of rotation of the semi-cylindrical veneer-producing zone is parallel to the veneer slicing knife. By mounting a semi-cylindrical veneer-producing zone parallel to the veneer slicing knife, all of the sheets of veneer sliced from the flitch extend the full length of the flitch, thereby eliminating waste from the veneer-producing zone. Of course, mounting the semi-cylindrical veneer-producing zone parallel to the veneer slicing knife generally implies that the mounting surface of a tapered flitch be oriented at an angle to the staylog mounting surface.

Since conventional mounting techniques require the mounting surface of the flitch to be positioned adjacent the mounting surface of the staylog, a need exists for a method and apparatus for preparing a tapered flitch to allow the flitch to be mounted on a staylog so as to orient the semi-cylindrical veneer-producing zone of the flitch parallel to the veneer slicing knife while the flitch mounting surface may be oriented at an angle to the staylog mounting surface.

SUMMARY OF THE INVENTION

The present invention includes an apparatus for preparing a flitch for slicing where the flitch includes a veneer-producing zone and a staylog-engaging zone. The apparatus comprises means for forming a plurality of holes in the flitch and means for holding a flitch in a predetermined orientation relative to the hole forming means. According to one aspect of the invention, the holes are arranged in a predetermined pattern and extend from a flitch mounting surface to the veneer-producing zone.

In one embodiment of the invention, the hole forming means includes at least one drill bit sized to bore pin dog-receiving holes into the flitch and at least one drill bit sized to bore pusher pin receiving holes into the flitch. A plurality of drill bits can be arranged in predetermined positions relative to each other to bore a plurality of pin dog-receiving holes and push pin-receiving holes simultaneously. In another embodiment of the invention, the hole forming means includes at least one dado saw blade for cutting dado holes into the flitch mounting surface.

The invention further includes means, coupled to the hole forming means, for positioning the hole forming means relative to the flitch. The positioning means includes actuator means coupled to the hole forming means for moving the hole forming means to a predetermined position adjacent the flitch. Drill operator input means is coupled to the actuator means for controlling the actuator means so as to direct the movement of the hole forming means.

In an alternative embodiment of the invention, the hole forming means includes a dado saw for forming dado holes in the flitch. The dado saw is moved across the mounting surface of the flitch and plunged into the flitch at predetermined positions to form the dado holes as the pin dog-receiving holes and pusher pin-receiving holes.

The invention also includes a method for preparing a flitch for slicing, wherein the flitch includes a staylog-engaging zone and a veneer-producing zone. The method comprises the steps of positioning the flitch in a preparing position and forming a plurality of holes in the flitch in a predetermined pattern so that each hole extends through the staylog-engaging zone to the veneer-producing zone. The forming step includes the step of positioning at least one drill bit at a predetermined position relative to the flitch. The forming step also includes the step of forming a plurality of pusher pin receiving holes that extend through the staylog-engaging zone to the veneer-producing zone.

According to one aspect of the invention, the flitch is mounted on the staylog by aligning the plurality of pin dog-receiving holes with a plurality of pin dogs coupled to the staylog and inserting the pin dogs into the pin dog-receiving holes and moving the flitch into engagement with the pin dogs.

A plurality of pusher pin-receiving holes are formed in the staylog-engaging zone and the mounting step further includes the step of aligning the plurality of pusher pin-receiving holes with a plurality of pusher pins coupled to the staylog, inserting the pusher pins into the pusher pin-receiving holes, and pushing the flitch with the pusher pins to move the flitch into engagement with the pin dogs.

In one embodiment of the invention, the pusher pins include movable dogs and the pin dogs include stationary dogs. The movable dogs are positioned to move the flitch into engagement with the stationary dogs and pinch the flitch therebetween. According to one aspect of the invention, the stationary dogs and movable dogs include flitch engaging portions configured to match the contour of dado holes.

Additional objects, features, and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

Figure 1:
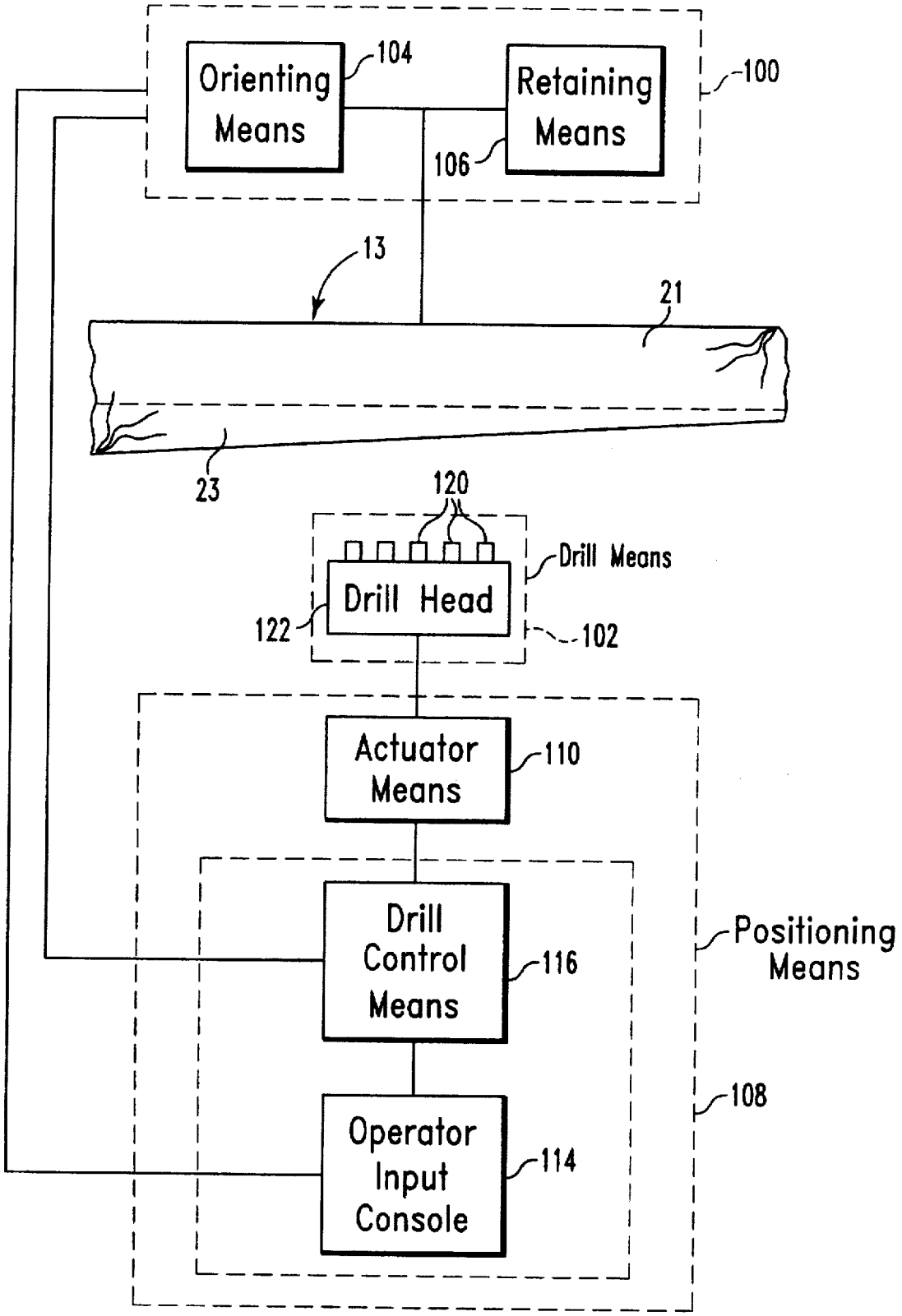
FIG. 1 is a schematic diagram of the apparatus of the present invention.

According to the present invention, a flitch 13 includes a veneer-producing zone 21 and a staylog-engaging zone 23 and is prepared for slicing by boring a plurality of holes 90, 92 through the staylog-engaging zone 23 to the veneer-producing zone 21. The holes are arranged to intermix pin dog-receiving holes 90 and pusher pin-receiving holes 92 in a predetermined pattern in the flitch 13. An exemplary pattern of holes 90, 92 can best be seen with reference to FIGS. 3 and 4. The pin dog-receiving holes 90 and pusher pin-receiving holes 92 are sized to receive pin dogs 54 and pusher pins 56, respectively, that are attached to a staylog 10. The apparatus includes holding means 100 for holding the flitch 13 in a predetermined orientation and hole forming means 102 for drilling the plurality of holes 90, 92.

As shown schematically in FIG. 1, the holding means 100 includes orienting means 104 for orienting the flitch 13 relative to the hole forming means 102 and retaining means 106 for retaining the flitch 13 in the drilling position. In the drilling position, the flitch 13 is oriented relative to the hole forming means 102 with the staylog-engaging zone 23 disposed between the veneer-producing zone 21 and the hole forming means 102 so that the hole forming means 102 forms pin dog-receiving holes 90 and pusher pin-receiving holes 92 in the staylog-engaging zone 23. The pin dog-receiving holes 90 and pusher pin-receiving holes 92 extend to, and define, a semi-cylindrical veneer-producing zone 21.

Positioning means 108 moves the hole forming means 102 to predetermined positions relative to the flitch 13 to drill the plurality of holes 90, 92. The positioning means 108 includes actuator means 110 coupled to the hole forming means 102 and drill control means 116 coupled to the actuator means 110. The actuator means 110 moves the hole forming means 102 to a predetermined position adjacent the flitch 13 and extends the hole forming means 102 into the flitch 13 to bore the plurality of holes 90, 92. The actuator means 110 can include hydraulic actuators and guide rails coupled to the hole forming means 102.

An operator input console 114 is coupled to the drill control means 116 and the holding means 100 and provides input means for an operator. An operator uses the input console 114 to order the holding means 100 to move the flitch 13 into a drilling position and to tell the drill control means 116 to proceed with a drilling operation. The drill control means 116 receives operator command signals from the operator input console 114 and position signals from the holding means 100 and generates drill control signals in response to the command and position signals. The drill control signals control the actuator means 110, which moves the hole forming means 102 based upon the drill control signals. The drill control means 116 can include a computer for storing and applying an algorithm for determining and outputting the appropriate response to operator command signals and position signals.

The hole forming means 102 can include a single drill bit 120 attached to a drill head 122. If a single drill bit 120 is used, the drill control means 116 can include control inputs for directing the drill bit 122 along a predetermined route to drill the plurality of holes 90, 92 sequentially.

The hole forming means 102 can include a plurality of drill bits 120 arranged in a predetermined pattern as part of a single drill head 122. The drill control means 116 can include control inputs to direct the drill head 122 to predetermined positions where the drill bits 120 drill a plurality of holes 90, 92 simultaneously. If desired, push pin receiving holes 92 and pin dog receiving holes 90 can be drilled simultaneously by attaching appropriate drill bits 120 to the drill head 122. Alternatively, each type of hole can be drilled separately, using different predetermined positions for each type of hole.

In an alternative embodiment of the invention, the apparatus can be modified to include means for moving the flitch 13 relative to a stationary drill head 122. That is, the flitch 13 can be moved from one drilling position to another, and the drilling means drills the plurality of holes into the flitch 13 once the flitch 13 is positioned.

Figure 2:
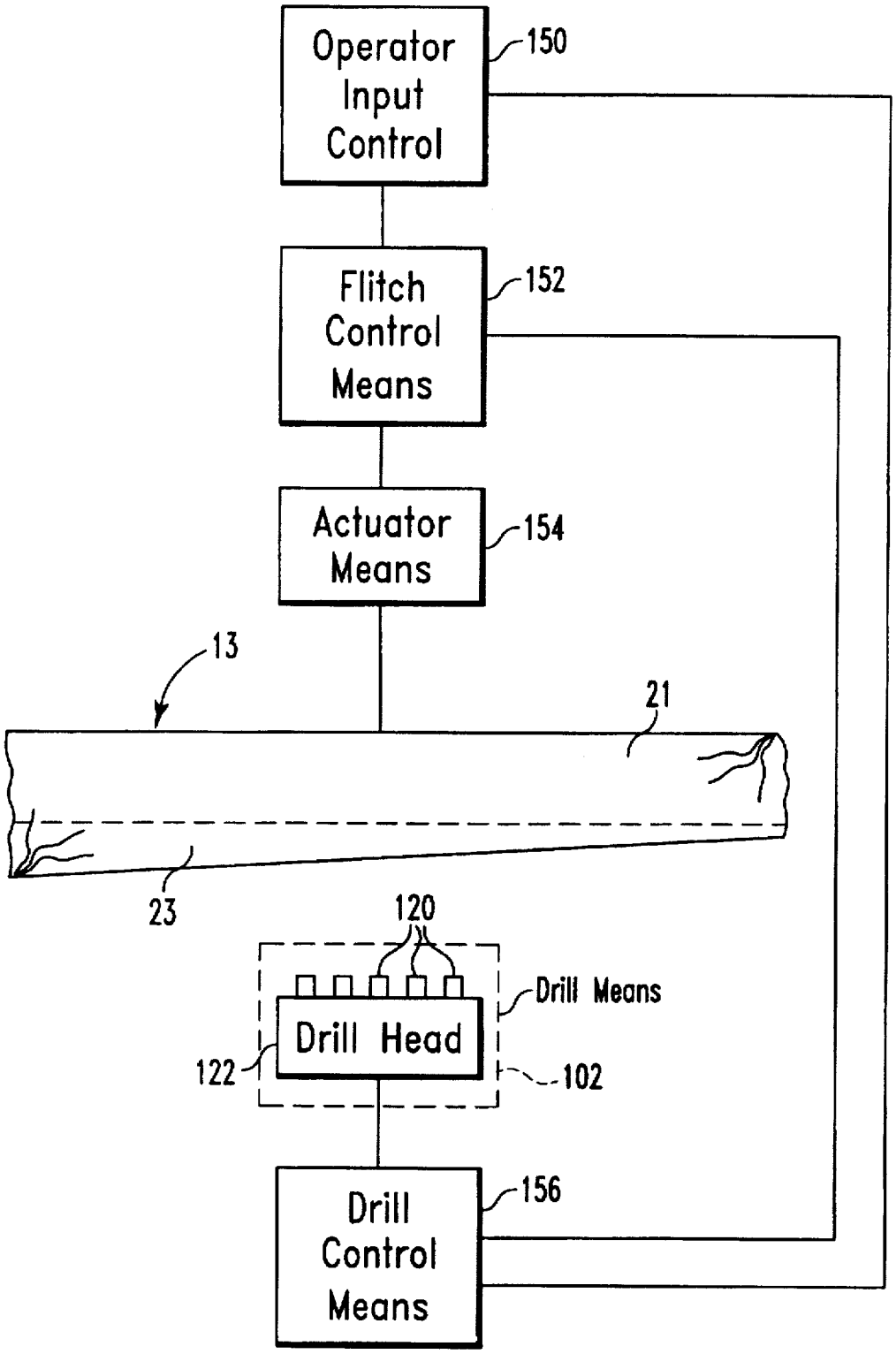
FIG. 2 is a schematic diagram of an alternative embodiment of the present invention.

As shown in FIG. 2, an alternative embodiment of the invention is configured to move the flitch from one drilling position to another while the drilling means remains essentially stationary. The apparatus includes an operator input console 150, a flitch control means 152, and actuator means 154. The operator uses the input console 150 to order the flitch control means 152 to move the flitch to a drilling position and to order the drill control means 156 to commence a drilling operation. The flitch control means 152 provides control signals to the actuator means 154 in response to the operator's orders and the flitch control means 152 moves the flitch 13 to a drilling position in response to the control signals. The drill control means 156 receives the operator's orders from the input console 150 and position signals from the flitch control means 152. When the flitch 13 is in the drilling position, the flitch control means 152 moves the flitch 13 into engagement with the hole forming means 102 to drill the plurality of holes 90, 92. Alternatively, when the flitch 13 is in the drilling position, the drill control means 156 can move the hole forming means 102 into engagement with the flitch 13 to drill the plurality of holes 90, 92.

The holes are drilled into the flitch 13 so as to prepare the flitch 13 for retention on a staylog 10. The staylog used with a flitch prepared according to the present invention incorporates pin dogs 54 and pusher pins 56. In operation, the flitch 13 is mounted on the staylog 10 by inserting the pin dogs 54 and pusher pins 56 into the pin dog-receiving holes 90 and pusher pin-receiving holes 92, respectively, and moving the pusher pins 56 to push the flitch 13 into engagement with the pin dogs 54. Each pin dog 54 includes a plurality of annular knife edges 80 to cut into the flitch 13 and retain the flitch 13 on the staylog 10.

Figure 3:
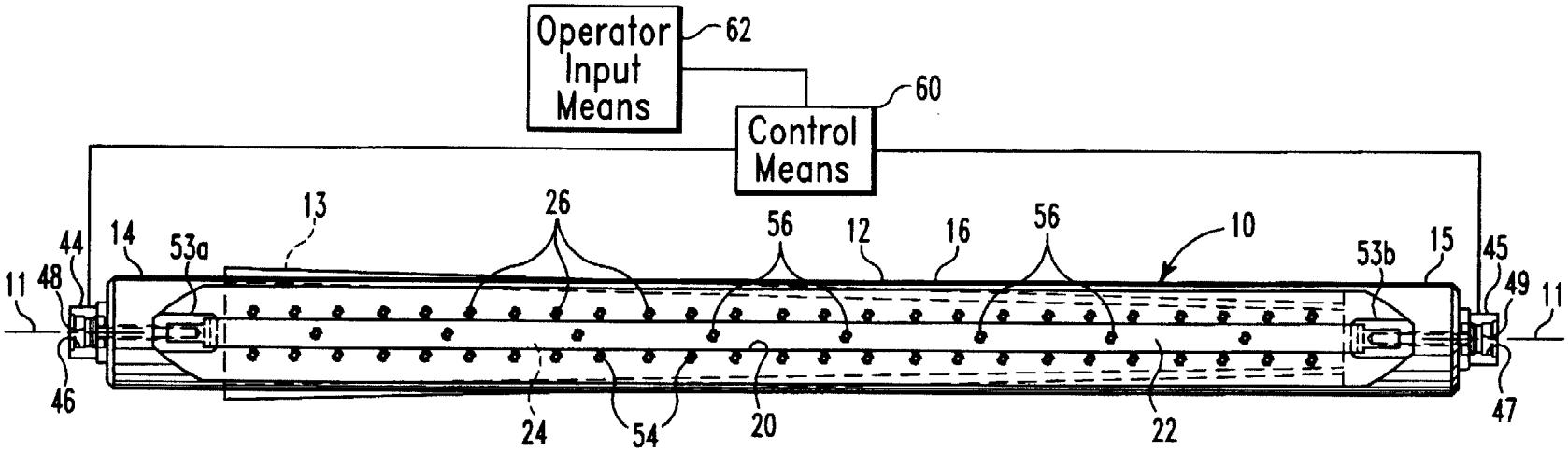
FIG. 3 is top plan view of a flitch (in dotted lines) prepared according to the invention and mounted on a staylog adapted for use with the flitch.
Figure 4:
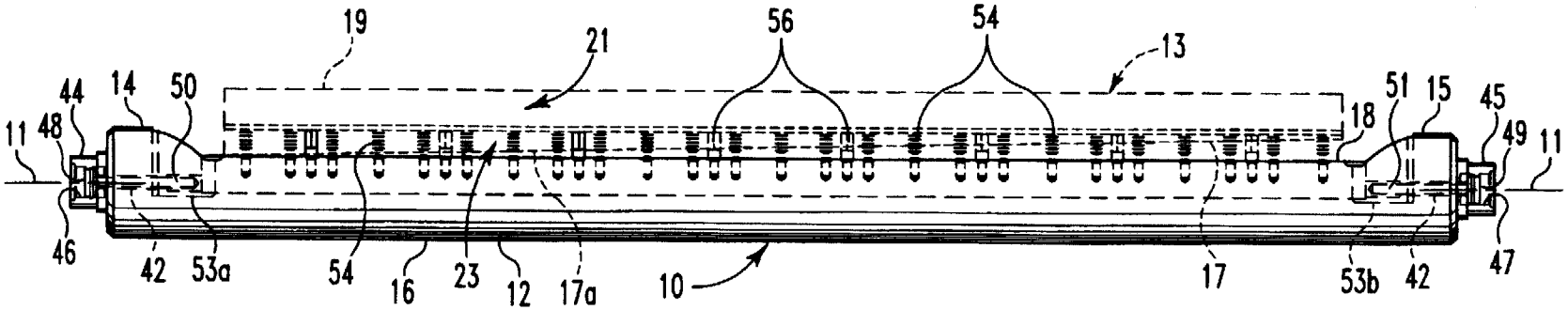
FIG. 4 is a side elevation of the flitch and staylog of FIG. 3.

A staylog 10 for use with the flitch prepared according to the present invention includes a cast cylinder 12 that defines end portions 14, 15 and a central portion 16 extending therebetween. As shown in FIGS. 3–4, a flitch 13 is mounted to the staylog 10 between the end portions 14, 15 and includes a mounting surface 17 and an outer veneer-producing surface 19.

The central portion 16 of the staylog 10 is milled to include a flat mounting surface 18 formed by a pair of mounting rails **16*a* and 16*b* defining an axial channel 20 therebetween extending along the longitudinal axis 11 of the cylinder 12. A pusher bar 22 is slidably disposed in the channel 20 and extends substantially along the length of the channel 20, the pusher bar 22 being several inches shorter than the channel 20 in order to allow for axial movement of the pusher bar 22 in the channel 20. The pusher bar 22 is sized to extend upwardly in the channel 20 so that the top surface 24 of the pusher bar 22 is substantially coplaner with, and forms part of, the mounting surface 18**.

Figure 5:
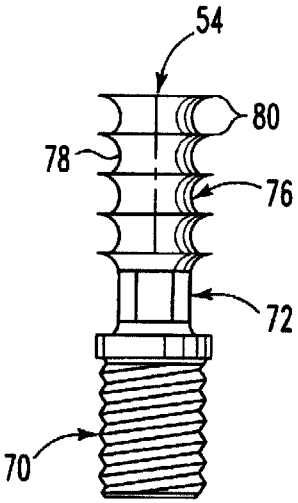
FIG. 5 is a side view of a stationary pin dog for use with the staylog of FIGS. 3 and 4 to retain a flitch prepared according to the present invention.

The mounting surface 18 includes a plurality of threaded pin dog holes 26. The threaded holes 26 are arranged in pairs along the length of the central portion 16, with the holes of each pair disposed on opposite sides of the channel 20, as shown in FIG. 3. A pin dog 54, shown more clearly in FIG. 5, is threaded into each pin dog hole 26 to provide a plurality of stationary pin dogs extending orthogonally from the mounting surface 18.

Figure 6:
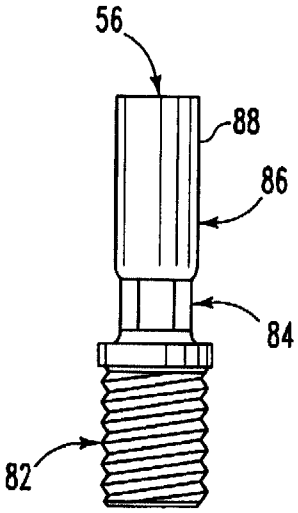
FIG. 6 is a side view of a pusher pin for use with the staylog of FIGS. 3 and 4 to push the flitch into engagement with the stationary pin dog.

The top surface 24 of the pusher bar 22 includes a plurality of threaded pusher pin holes 28 arranged in spaced-apart relation along the length of the pusher bar 22. A pusher pin 56, shown more clearly in FIG. 6, is threaded into each pusher pin hole 28. A preferred arrangement of pin dogs 54 and pusher pins 56 is shown in FIG. 3, but other arrangements can be used without departing from the scope of the invention.

The end portions 14, 15 of the staylog 10 are essentially mirror images of each other, and include a central bore 42 that extends coaxially along the longitudinal axis 11 of the cylinder 12 and opens into the central channel 20. Piston housings 44, 45 are attached to the end portions 14, 15, respectively, and form cylinders 46, 47 which enclose drive pistons 48, 49, respectively. The pistons 48, 49 are positioned for movement along the axis 11. Pusher blocks **53*a*, 53*b* are disposed in the central bore 42 adjacent each end of the pusher bar 22. Piston rods 50, 51 are attached to the pistons 48, 49, respectively, and extend into the bore 42 to abut the pusher blocks 53*a*, 53*b***, respectively.

The pistons 48, 49 are controlled in a conventional manner by piston control means 60 which directs the flow of operating fluid from a reservoir (not shown) to one of the pistons 48, 49 and simultaneously permits a return flow of operating fluid from the other piston 49, 48 to the reservoir. Thus, application of operating fluid to piston 48 extends the piston rod 50 to drive the pusher block **53*a* and pusher bar 22 to the right. At the same time, operating fluid is vented from piston 49 back to the reservoir to prevent piston 49 from blocking movement of the pusher bar 22 to the right. Application of operating fluid to piston 49 extends the piston rod 51 to drive the pusher block 53*b* and pusher bar 22 to the left. At the same time, operating fluid is vented from piston 48 back to the reservoir to prevent piston 48 from blocking movement of the pusher bar 22 to the left. It will be appreciated that a single piston and piston rod can be attached directly to the pusher bar 22 to move the pusher bar 22** in both directions. In that case, the operating fluid would be directed to opposite sides of the piston.

The piston control means 60 includes control valves and actuating means connected as necessary to direct the operating fluid to the pistons 48, 49 and return the fluid to the reservoir. Operator input means 62 controls the flow of operating fluid by directing the piston control means 60 to direct operating fluid to piston 48 to drive the pusher bar 22 to the right or direct operating fluid to piston 49 to drive the pusher bar 22 to the left. Operator input means 62 can include actuating levers, pushbuttons or the like to indicate a desired direction of pusher bar movement.

As shown in FIG. 5, pin dogs 54 include a lower threaded portion 70, a central polygon-shaped portion 72, and an upper flitch-engaging portion 76. The lower threaded portion 70 includes external threads for threadedly engaging the pin dog holes 26. When used in conjunction with shims or washers, the lower threaded portion 70 also provides means for adjusting the orthogonal extension of the pin dogs relative to the mounting surface 18. The central polygon-shaped portion 72 is preferably hexagonal for engaging a wrench (not shown) for screwing the pin dog 54 into the pin dog hole 26. The upper flitch-engaging portion 76 includes a scalloped side wall 78 defining a plurality of annular knife edges 80 for engaging a flitch 13. The annular knife edges 80 are axially spaced along the pin dogs 54 so as to be positioned at various distances from the staylog 10.

Pusher pin 56 includes a lower threaded portion 82, a central polygon-shaped portion 84, and an upper flitch-engaging portion 86. The lower threaded portion 82 and the central polygon-shaped portion 84 are substantially similar in design and identical in function to their counterparts 70, 72, respectively, on the pin dogs 54. The upper portion 86 includes a cylindrical side wall 88 for moving the flitch 13.

A flitch 13 includes, generally, a conical portion corresponding to the base of the tree from which it was taken, and veneer taken from this portion of the flitch is frequently of the highest quality. As the flitch is normally mounted to the staylog, its outer surface and veneer-producing zone are not parallel to the slicing knife so that upon rotation of the staylog, only short waste sliced veneer is produced from the thicker end of the flitch. In the invention, the veneer-producing zone, which is generally a cylindrical segment, most generally a semi-cylindrical portion, is arranged with its axis of rotation parallel to the slicing knife and the axis of rotation of the staylog.

Figure 7:
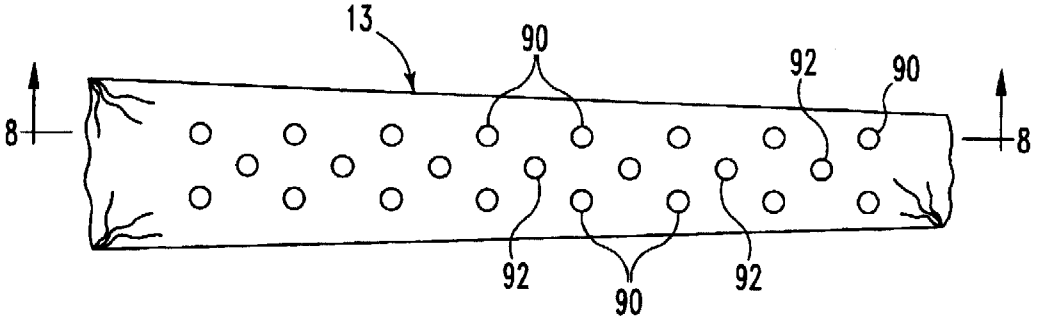
FIG. 7 is a bottom view of a flitch prepared according to the present invention showing pin dog-receiving holes and pusher pin receiving holes.
Figure 8:
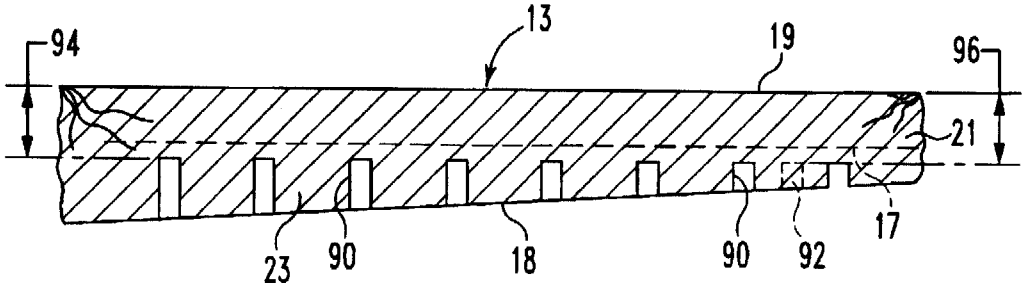
FIG. 8 is a sectional view of the flitch of FIG. 7 taken along lines 8—8 in FIG. 7.

For example, the flitch 13 can be prepared for slicing by boring holes in the mounting surface 17 for receiving the pin dogs 54 and the pusher pins 56. As shown in FIGS. 7 and 8, a first plurality of pin dog-receiving holes 90 are sized to fit and positioned to engage the pin dogs 54, and a second plurality of pusher pin-receiving holes 92 are sized to fit and positioned to engage the pusher pins 56. The pin dog-receiving holes 90 are formed to extend a predetermined distance from the mounting surface 18 of the staylog 10 into the flitch 13 so that all of the holes 90 terminate at a first distance 94 from the veneer-producing surface 19, thereby forming a veneer-producing zone 21, best illustrated in FIGS. 4 and 8. Likewise, the pusher pin-receiving holes 92 terminate at a second distance 96 from the veneer-producing surface 19, wherein the first distance 94 can be equal to the second distance 96. The primary factors in determining the first and second distances 94, 96 is maximizing the depth of the veneer-producing zone 21 while affording maximum surface contact between the pusher pins 56 and the pusher pin-receiving holes 92 as well as maximum engaging contact between the pin dogs 54 and the flitch 13.

The flitch 13 is positioned on the staylog 10 with the pin dogs 54 and pusher pins 56 disposed in their respective holes. When positioning the flitch 13 on the staylog 10, the flitch 13 is aligned so that the axis of rotation of the semi-cylindrical veneer-producing zone 21 is parallel to the slicing knife. In the embodiment of FIGS. 3 and 4, the axis of rotation of the semi-cylindrical veneer-producing zone 21 is parallel to the mounting surface 18 of the staylog 10. Due to the natural taper of the flitch 13, the mounting surface 17 of the flitch 13 will be positioned at an angle to the mounting surface 18 of the staylog 10. Consequently, the holes 90, 92 will have different depths in order to provide a constant-thickness veneer-producing zone 21.

Advantageously, the plurality of annular knife edges 80 on each pin dog 54 allows each pin dog 54 to engage the flitch 13 without regard to the distance between the mounting surface 17 of the flitch 13 and the mounting surface 18 of the staylog 10. Moreover, in those areas where the flitch 13 is thicker, and therefore more massive, more annular knife edges 80 engage the flitch 13 to provide additional holding capability where needed.

Once the flitch 13 is positioned on the staylog, the operator commands the pusher bar 22 to move in a first direction. The movement of the pusher bar 22 causes the pusher pins 56 to move the flitch 13 in the first direction until the flitch 13 engages the annular knife edges 80 on the pin dogs 54. The annular knife edges 80 cut into the flitch 13 and hold the flitch 13 in position. When the veneer has been sliced from the flitch 13, the operator commands the pusher bar 22 to move in a second direction opposite to the first direction. The movement of the pusher bar 22 causes the pusher pins 56 to move the flitch 13 in the second direction until the flitch 13 disengages from the annular knife edges 80. Once the flitch 13 is disengaged from the pin dogs 54, it can be removed and replaced with another flitch 13.

If, because of the forces imposed on the flitch as it is sliced, the engagement between the flitch engaging surfaces at the pin dogs 54 and the engagement surfaces of the pin receiving holes 92 becomes too loose, the operator can command the pusher bar 22 to move in a second direction opposite to the first direction. The movement of the pusher bar 22 causes the pusher pins 56 to move the flitch 13 in the second direction until the pin dogs 54 engage the flitch at different engagement surfaces of the pin-receiving holes 92 for completion of the slicing operation. When the slicing operation has been completed, the pusher bar 22 can be positioned so flitch 13 disengages from the annular knife edges 80. Once the flitch 13 is disengaged from the pin dogs 54, it can be removed and replaced with another flitch 13.

Preferred pusher pins 56 do not include knife edges in order to avoid pusher pin engagement with the flitch 13 while disengaging the flitch 13 from the pin dogs 56. If the pusher pins 56 included knife edges, the flitch 13 could remain engaged with the pusher pins, thereby preventing the easy removal of the flitch 13 from the staylog 10.

It will be appreciated that the dogs 54 could also be mounted on a conventional staylog and the flitch retained by pushing a movable pin dog toward a stationary pin dog and pinching the flitch 13 therebetween in a conventional fashion. Modifying a conventional staylog to include stationary and movable dogs 54 would eliminate the need for pusher pins 56 and pusher pin-receiving holes 92, thereby simplifying flitch preparation while still allowing for multiple knife edges 80 to engage the flitch 13 at various distances from the staylog mounting surface 18.

The preceding description related to dogs 54 and pusher pins 56 used with a non-conventional staylog 10. However, it would be clear to one of ordinary skill in the art that a conventional staylog could be modified to incorporate the present invention without departing from the scope of the invention. For example, FIGS. 9–12 illustrate alternative embodiments of the invention that can be incorporated into a conventional staylog.

Figure 9A:
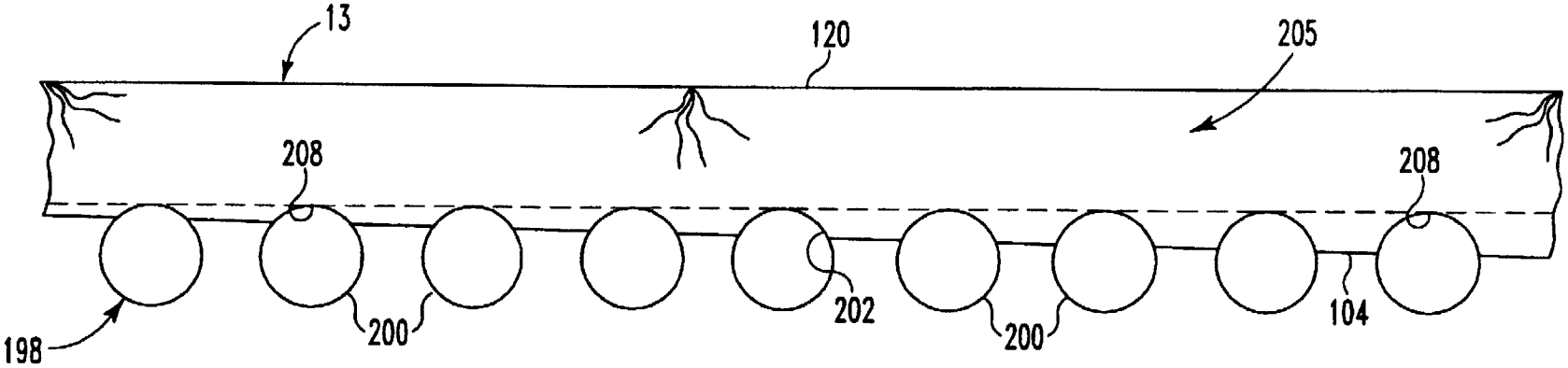
FIG. 9*a*–9*b* show illustrative positions and depths of plunge cuts made by a dado saw.
Figure 9B:
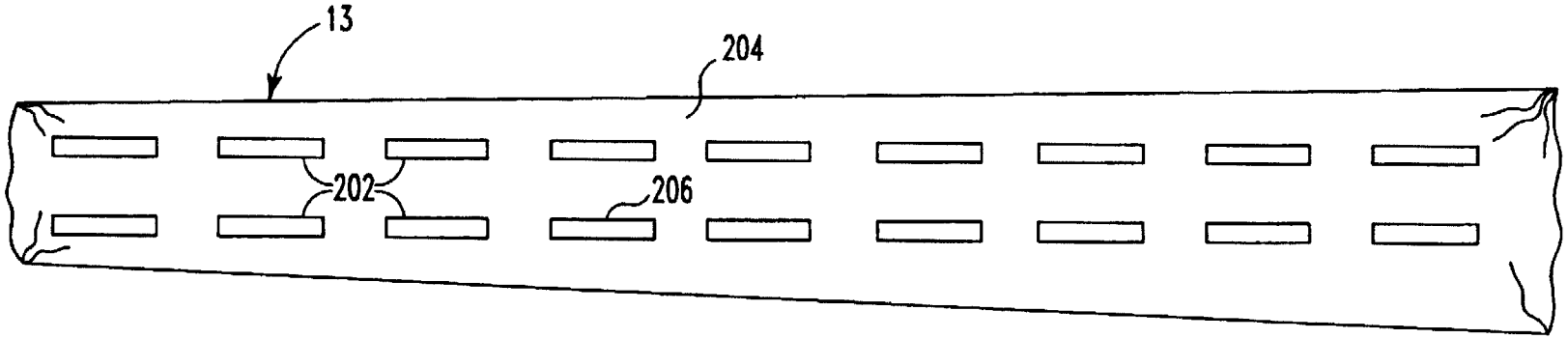

As generally indicated in FIGS. **9*a*–9*b*, hole forming means 198, illustratively a dado saw blade 200, can be used to cut dado holes 202 into the flitch mounting surface 204. The dado holes 202 have a generally rectangular opening 206 at the flitch mounting surface 204 (FIG. 9*b*) and a generally circular depth profile 208 (FIG. 9*a*). Dado holes 202 can be formed efficiently by moving a dado saw blade 200 along the flitch mounting surface 204 and plunging the saw blade 200 into the flitch at the desired positions to a desired depth, which would be determined by the thickness of the veneer-producing zone 205. Of course, the dado holes 202 can be formed by using other hole forming means, such as a router, drill, lasers, or the like. It is also possible to vary the shape of the dado holes 202 without departing from the scope of the invention. For example, the hole forming means 198** can be used to bore generally rectangular holes having a flat, rather than circular, depth profile.

Figure 10B:
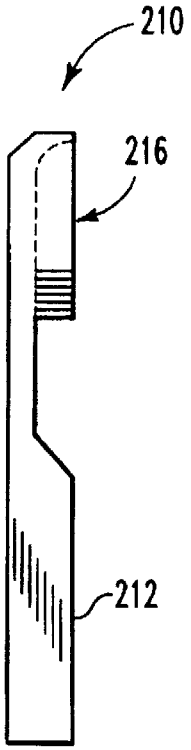
FIGS. 10*a*–10*b* show a dog configured to match a plunge cut of FIGS. 9*a*–9*b*.
Figure 10A:
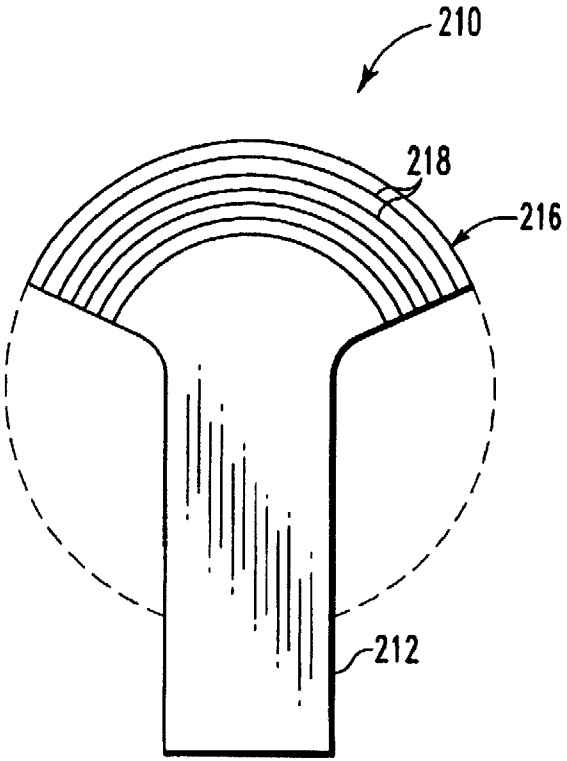
Figure 12B:
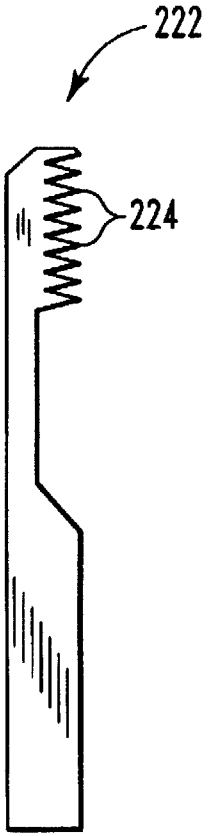
FIGS. 12*a*–12*b* show an alternative embodiment of the dog of FIGS. 10*a*–10*b*.
Figure 12A:
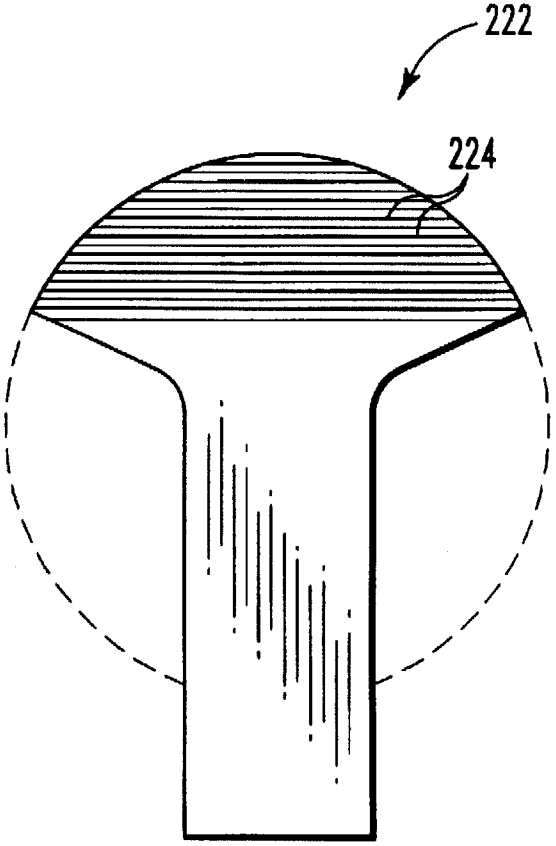

A flitch-retaining dog 210 for use with the dado holes 202 is illustrated in FIGS. 10*a*–10*b*. The dogs 210 include an elongated actuating arm 212 and a flitch-engaging portion 216 extending from the actuating arm 212. The flitch-engaging portion 216 is configured to conform to the depth profile 208 of the dado holes 202 and includes a plurality of circular flitch-engaging knife edges 218 configured to run parallel to the depth profile 208 of the dado hole 202. In an alternative embodiment, dogs 222 include straight knife edges 224, as shown in FIGS. 12*a*–12*b*, configured to run generally parallel to the veneer-producing surface 220 or the mounting surface of the flitch, whichever is preferred. Of course, if the selected dado holes 202 include a flat depth profile, the dogs can include a rectangular flitch-engaging portion to conform to the flat depth profile.

Figure 11:
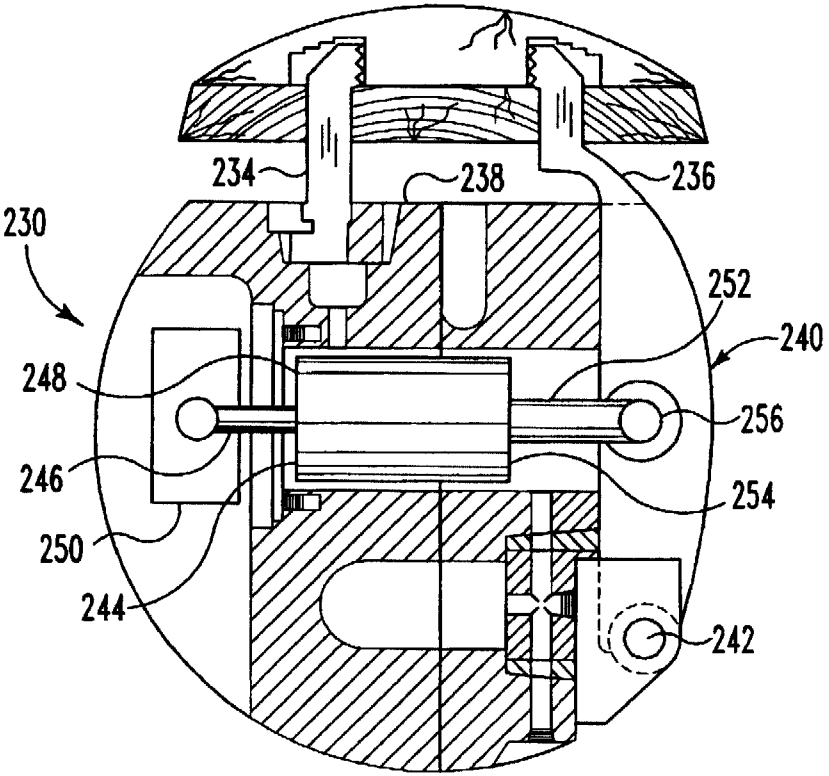
FIG. 11 illustrates the dogs of FIGS. 10*a*–10*b* installed on a conventional staylog.

Dogs 210, 222 can be coupled to a conventional staylog 230, as illustratively shown in FIG. 11. The dogs 210, 222 are mounted to the staylog 230 to form stationary dogs 234 and movable dogs 236 which are movable toward and away from the stationary dogs 250 to move the flitch 13 into engagement with the stationary dogs 234. The stationary dogs 234 extend from the staylog mounting surface 238 and the movable dogs 236 are formed on one end of a pivotable lever arm 240. The lever arm 240 pivots about pivot pin 242 in response to actuation of a conventional hydraulic (or pneumatic) piston cylinder 244.

The piston-cylinder 244 can be a self-contained unit installed in the staylog 230, as illustrated in FIG. 11. The piston-cylinder 244 includes a connecting rod 246 coupled to a trunion block 250, fitted into the staylog 230, and a first end 248 of the cylinder 244. A piston rod 252 extends from a second end 254 of the cylinder 244 to a connecting pin 256 formed in the lever arm 240.

The narrowest portion of the flitch 13 would be positioned farthest from the staylog mounting surface 204, due to the taper of the log, as previously described with reference to the embodiments of FIGS. 1–7.

An important feature of the present invention is the use of individual holes bored into the flitch mounting surface to accept flitch-retaining dogs, with the holes being separated from each other by areas of solid wood. It is the areas of solid wood between the holes that strengthen the edges of the flitch to eliminate flexing of the flitch edge under pressure from the knife. Eliminating flexing at the flitch edge allows a slicer to remove more of the best veneer from the edges without the problem of nonuniform and unacceptable veneer that arises in conventional flitch-retaining methods and apparatus.

In another alternative embodiment of the invention, conventional stationary and movable dogs operate in a conventional fashion to retain the flitch on the staylog. However, the ends of the staylog are differentially offset from the axis of rotation of the staylog so as to maintain the veneer-producing zone parallel to the knife. In being differentially offset, one end of the staylog is offset from the axis of rotation by a greater distance than the other. That permits the thicker end of a tapered flitch to be retained at the same distance from the knife as the thinner end.

In yet another embodiment of the invention, the flitch is mounted to the staylog mounting surface in the conventional fashion, but the staylog mounting surface is hinged, either at its end or its center, to orient the veneer-producing zone parallel to the slicing knife.

Although the invention has been described in detail with reference to a certain preferred embodiment, variations and modifications exist within the scope and spirit of the invention as described and defined in the following claims. For example, although the invention has been described in a rotary veneer slicer where it can be particularly advantageous in reducing waste, it can also be advantageously used in a transversely moving veneer slicer.

I claim:

1. An apparatus for preparing a flitch for slicing, the flitch including a veneer-producing zone and a staylog-engaging zone, the apparatus comprising:

means for forming a plurality of holes in the flitch arranged in a predetermined pattern, and means for holding a flitch in a predetermined orientation relative to the hole-forming means, said holding means and said hole-forming means cooperating upon relative movement one with respect to another so that a plurality of said holes extend into said flitch to substantially the same distance from said veneer-producing zone.

2. The apparatus of claim 1 further including means coupled to the hole-forming means for positioning the hole-forming means relative to the flitch.

3. The apparatus of claim 2 wherein the positioning means includes actuator means coupled to the hole-forming means for moving the hole-forming means to a predetermined position adjacent the flitch, and an operator input means coupled to the actuator means for controlling movement of the hole-forming means.

4. The apparatus of claim 3 wherein the forming means includes a drill head and a plurality of drill bits coupled to the drill head for simultaneously boring a plurality of holes into the flitch.

5. The apparatus of claim 4 wherein the plurality of drill bits are arranged in said predetermined pattern relative to each other to bore a plurality of pin dog-receiving holes simultaneously.

6. The apparatus of claim 4 wherein the hole-forming means further includes at least one drill bit sized to bore a pusher pin receiving hole into the flitch.

7. The apparatus of claim 1 wherein the holding means includes actuator means for moving the flitch relative to the hole-forming means, and flitch control means coupled to the actuator means to control the actuator means and coupled to the hole-forming means for providing a position signal to a hole-forming control means.

8. The apparatus of claim 7 wherein the hole-forming control means receives an operator command signal from an operator input console and a position signal from the flitch control means and produces a control signal to control the hole-forming means in response to the position signal and command signal.

9. The apparatus of claim 8 wherein the hole-forming control means includes a computer for determining the appropriate response to the operator command signal.

10. The apparatus of claim 1 wherein the hole-forming means includes at least one dado saw blade positioned to cut dado holes in the flitch.

11. The apparatus of claim 7 wherein the hole-forming means includes at least one dado saw blade positioned to cut dado holes in the flitch.

12. A method of preparing a flitch for retention on a staylog and of slicing veneer from its outer surface, the flitch including a veneer-producing zone and a staylog-engaging zone, the method comprising the steps of:

positioning the flitch, and forming a plurality of holes in a predetermined pattern extending through the staylog-engaging zone into the flitch, said holes being formed so as to permit engagement and retention of the flitch by the staylog in a position for removal of veneer at substantially the entire length of the outermost surface of the veneer-producing zone.

13. The method of claim 12 wherein the forming step includes the step of forming the plurality of holes simultaneously.

14. The method of claim 13 wherein the forming step includes the step of forming a plurality of pusher pin receiving holes that extend through the staylog-engaging zone to the veneer-producing zone.

15. The method of claim 13 wherein the forming step includes the step of forming at least one pusher pin receiving hole simultaneously with formation of a plurality of pin dog-receiving holes.

16. The method of claim 13 wherein the forming step includes the step of forming at least one dado hole that extends through the staylog-engaging zone to the veneer-producing zone.

17. The method of claim 13 wherein the plurality of holes includes a plurality of pin dog-receiving holes, the method further including the step of mounting the flitch on the staylog by aligning the plurality of pin dog-receiving holes with a plurality of pin dogs on the staylog and inserting the pin dogs into the pin dog-receiving holes and moving the flitch into engagement with the pin dogs.

18. The method of claim 17 further including the step of forming a plurality of pusher pin-receiving holes in the staylog-engaging zone and the mounting step further includes the step of aligning the plurality of pusher pin-receiving holes with a plurality of pusher pins on the staylog and inserting the pusher pins into the pusher pin-receiving holes and moving the pusher pins to push the flitch into engagement with the pin dogs.

19. An apparatus for preparing a flitch for retention on a staylog and slicing, the flitch including a veneer-producing zone and a staylog-engaging zone, the apparatus comprising:

means for holding a flitch, and hole forming means positioned relative to the holding means for drilling a plurality of holes, the holes being arranged in a predetermined pattern and extending into the staylog-engaging zone to define a boundary of the veneer-producing zone.

20. The apparatus of claim 19 wherein the flitch is tapered and the veneer-producing zone is generally semi-cylindrical.

21. The apparatus of claim 19 wherein the hole forming means includes a drill head and a plurality of drill bits coupled to the drill head for drilling the plurality of pin dog-receiving holes simultaneously.

22. The apparatus of claim 19 wherein the hole-forming means includes at least one dado saw blade.

23. The apparatus of claim 19 wherein the holding means includes means for orienting the flitch relative to the hole forming means and means for retaining the flitch in the oriented position.

24. The apparatus of claim 19 wherein the hole forming means includes means for moving the hole forming means in a plane between at least two predetermined drilling positions and the holding means includes means for positioning the flitch so that an axis of rotation of the veneer-producing zone is generally parallel to the plane of movement of the hole forming means.

25. An apparatus for preparing a flitch for slicing, the flitch including a veneer-producing zone and a staylog-engaging zone, the apparatus comprising:

hole-forming means for forming a plurality of holes in the flitch, the holes being arranged in a predetermined pattern and extending to adjacent the veneer-producing zone, and means for holding a flitch in a predetermined orientation relative to the hole-forming means, wherein the holding means includes actuator means for moving the flitch relative to the hole-forming means.

26. The apparatus of claim 25 wherein the holding means further includes flitch control means coupled to the actuator means for controlling the actuator means and to the hole forming means for providing a position signal to the hole forming means.

27. The apparatus of claim 26 wherein the hole forming means includes a drill and drill control means for receiving an operator command signal from an operator input console and a position signal from the flitch control means and produces a drill control signal to control the drill in response to the position signal and command signal.

28. Apparatus for preparing a tapered flitch for cutting veneer from its outermost surface, comprising hole-forming means, means for retaining a flitch for engagement with said hole-forming means, means for providing relative movement between said hole-forming means and said flitch retaining means, and means for controlling the relative movement of said hole-forming means and said flitch retaining means and for providing a plurality of holes in said flitch, a plurality of said holes terminating at substantially the same distance from the outermost surface of the flitch.

29. The apparatus of claim 28 wherein said hole-forming means comprises a plurality of drills and said flitch retaining means retains said flitch with its outermost surface substantially parallel with said plurality of drills.

30. The apparatus of claim 28 wherein said flitch retaining means is oriented to retain said flitch to provide an axis of rotation for a veneer-producing zone substantially parallel with the terminations of said holes.

31. A method of preparing a tapered flitch for retention by a staylog that is rotatable about an axis of rotation and of cutting veneer from its tapered outer surface with a veneer knife during rotation of the staylog, comprising holding the flitch for preparation, providing a plurality of holes in said tapered flitch for engagement by said staylog and retention thereon for cutting by forming said plurality of holes to terminate at distances providing engagement and retention by said staylog in position for cutting veneer at substantially the entire length of the outermost surface of said tapered outer surface.

32. The apparatus of claim 1 wherein said veneer-producing zone has a tapered outer surface and said flitch holding means provides a predetermined orientation with the outermost surface of said tapered outer surface substantially parallel with said hole-forming means.

33. The apparatus of claim 1 wherein said veneer-producing zone has a tapered outer surface and said hole-forming means provides a plurality of holes extending to substantially the same distance from the outermost surface of said tapered outer surface.

34. The method of claim 13 wherein the outer surface of the flitch is tapered and said flitch is positioned to permit a plurality of holes to be formed to substantially the same distance from the outer surface.

* * * * *